United States Patent [19]

Pachmayr et al.

[11] 4,148,149

[45] Apr. 10, 1979

[54] CUSHIONED GUN GRIP

[75] Inventors: Frank A. Pachmayr, Los Angeles; Jack R. Farrar, Whittier, both of Calif.

[73] Assignee: Pachmayr Gun Works, Inc., Los Angeles, Calif.

[21] Appl. No.: 872,329

[22] Filed: Jan. 25, 1978

[51] Int. Cl.[2] ..... F41C 23/00

[52] U.S. Cl. ..... 42/71 P

[58] Field of Search ..... 42/71 P, 71 R, 74, 75 C; 29/1.1

[56] References Cited

U.S. PATENT DOCUMENTS

| | | | |
|---|---|---|---|
| 963,444 | 7/1910 | Johnson | 42/71 R |
| 1,049,739 | 1/1913 | Leach, Jr. | 42/71 P |
| 1,279,372 | 9/1918 | Lempie | 42/71 P |
| 1,531,796 | 3/1925 | Loomis | 42/71 P |
| 1,951,135 | 3/1934 | Emswiler | 42/71 R |
| 2,034,632 | 3/1936 | Rice | 42/71 P |
| 2,292,351 | 8/1942 | Carpenter et al. | 42/71 R |
| 2,744,448 | 5/1956 | Allen | 42/71 P |
| 3,561,149 | 2/1971 | Center | 42/41 |
| 3,672,084 | 6/1972 | Pachmayr | 42/71 P |
| 3,683,535 | 8/1972 | Lewis | 42/71 P |
| 3,815,270 | 6/1974 | Pachmayr | 42/71 P |
| 4,043,066 | 8/1977 | Pachmayr et al. | 42/71 P |

FOREIGN PATENT DOCUMENTS

| | | | |
|---|---|---|---|
| 1805399 | 8/1970 | Fed. Rep. of Germany | 42/71 P |

*Primary Examiner*—Charles T. Jordan
*Attorney, Agent, or Firm*—William P. Green

[57] ABSTRACT

A cushioned gun grip to be applied to a pistol or other gun of a type having a grip mounting projection extending downwardly and rearwardly from the frame of the gun, with the grip containing a recess dimensioned to receive the projection, and with the grip being retainable on the frame by a fastener extending through the grip and connecting to the projection. The grip includes an elastomeric body extending about the recess and projection, and a reinforcing structure stiffer than and embedded within the elastomeric material and having portions received at opposite sides of the recess and projection and having a portion at the lower end of the reinforcing structure against which a fastener can exert upward clamping force to attach the grip to the frame.

29 Claims, 9 Drawing Figures

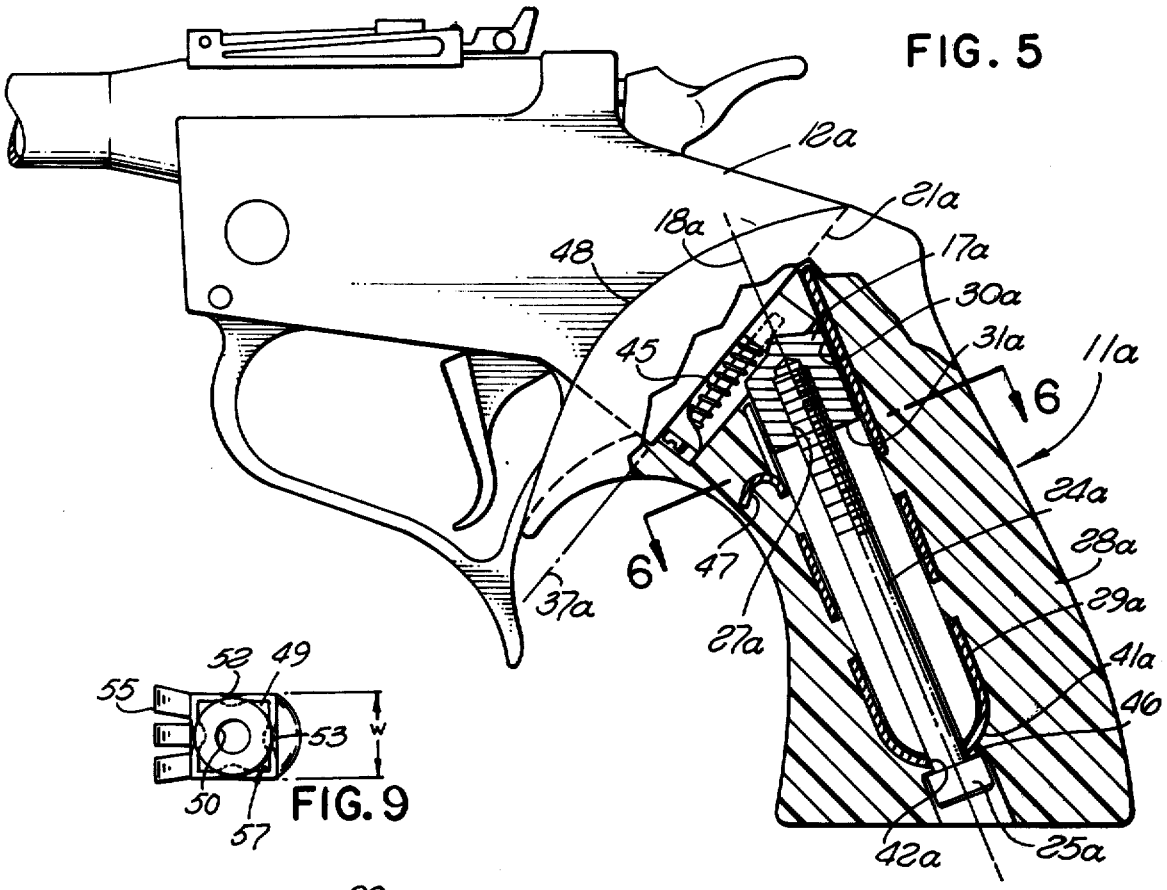
FIG. 5
FIG. 9
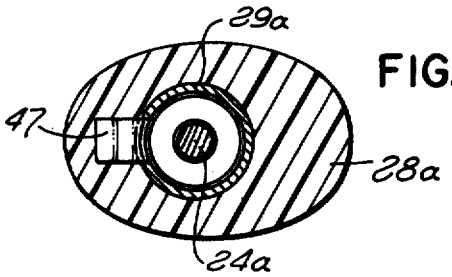
FIG. 6
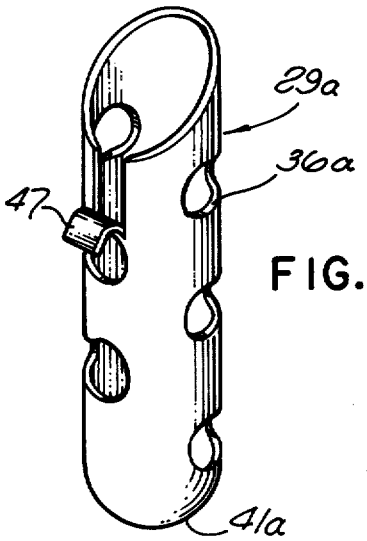
FIG. 7
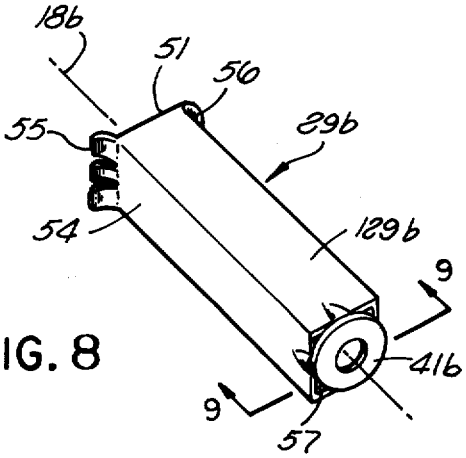
FIG. 8

CUSHIONED GUN GRIP

BACKGROUND OF THE INVENTION

This invention relates to improved cushioning grips for guns having handles of the pistol type.

The comfort and effectiveness with which a gun may be held may be greatly enhanced by forming the grip of the gun to have cushioned outer surfaces of rubber or other elastomeric material for contacting the user's hand. To attain this result, various prior art patents have disclosed cushion grip units adapted for application to certain known types of pistol handles. For example, U.S. Pat. No. 3,672,084 shows a grip arrangement including two side sections to be received at opposite sides of a revolver handle and secured together by a screw extending through the handle and between the two side sections, with each side panel including a body of elastomeric material and a stiffer reinforcing plate embedded therein. Our U.S. patent application Ser. No. 838,805, filed Oct. 3, 1977 on "CUSHIONED PISTOL GRIP" shows another revolver handle grip device including reinforced side panels which are integrallly secured together by a flexible elastomeric strap extending across the back of the handle. U.S. Pats. Nos. 3,815,270 and 4,043,066 disclose other cushioned grip units which are designed for use on automatic pistols. In the first of these patents, two side panels formed of elastomeric material and containing reinforcing plates are secured integrally together by a flexible strap extending across the front of the pistol handle, while in the second of these patents, U.S. Pat. No. 4,043,066, two reinforced side panels interfit, with separately formed straps extending across both the front and rear of the automatic piston handle. Another cushioning grip is shown in U.S. Pat. No. 1,049,739, and consists merely of a flexible elastomeric sleeve or cover which is adapted to be stretched slightly and slipped onto a gun handle, and which in its installed position contracts into tight engagement with the handle for reception thereon by virtue of the elasticity of the material.

The present invention is directed to the provision of a cushioned grip which is especially designed for application to another known and conventional type of gun frame. More specifically, the frames with which the invention is concerned are of a type having a grip mounting projection or tang which projects from the rear portion of the gun frame in a downward and rearward direction, and which conventionally carries a rigid, one piece grip element shaped externally to a handle configuration to be grasped by a user's hand. In the usual arrangement, this rigid grip body contains a recess shaped and dimensioned to slidably receive the projection on the gun frame, with a retaining screw extending upwardly through a passage in the grip body from its lower end and connecting to the discussed projection on the frame to secure the grip body to the frame. The head of the screw bears upwardly against a shoulder formed in the lower portion of the rigid grip body to clamp it upwardly against the frame. The recess within the rigid body may be shaped to have a cross-section corresponding substantially to that of the projection on the frame, to fit closely thereabout and thus locate the grip body relative to the frame.

SUMMARY OF THE INVENTION

A cushioned grip unit constructed in accordance with the present invention is adapted to be connected to a frame of the above-discussed type in substitution for the standard rigid grip element. To enable such attachment, a unit embodying the invention contains an internal recess similar to that provided in the rigid type part and which receives the mounting projection in the assembled condition of the parts, with a fastener extending upwardly through the grip unit and connecting to the projection as in the rigid grip arrangement. However, the grip unit is not molded of a single mass of rigid material, but rather includes a body of elastomeric material extending about the recess and projection and having outer gripping surfaces for contact with a user's hand, and a reinforcing structure which is embedded within and is stiffer than the elastomeric material and gives it sufficient rigidity to enable effective holding and aiming of the gun while at the same time cushioning the contact between the user's hand and the grip. The reinforcing structure has portions received at opposite sides of the recess and the frame projection which extends into the recess, and has in addition a portion positioned to receive force exerted by the retaining fastener in the assembled condition of the parts, in a relation in essence clamping the reinforcing structure between the fastener and the gun frame to positively retain and locate the reinforcing structure relative to the frame. The reinforcing structure then, in turn, acts to effectively locate the elastomeric material which is carried thereby, and prevent excessive deformation of that material.

In the preferred arrangement, the reinforcing structure takes the form essentially of a tube, which is shaped to extend about the recess and projection, and desirably has a cross-sectional configuration corresponding generally to that of the projection but slightly greater in size. The tube may have sidewall apertures into which the elastomeric material extends in bonded relation, and preferably carries at the lower end of the tube a portion of the reinforcing structure disposed across the end of the tube and against which the screw exerts upward force. This lower portion of the tube desirably is rounded to have a downwardly convex portion against which the clamping force of the screw is exerted upwardly, and containing an opening through which a reduced dimension threaded shank of the screw projects. At its upper end, the tube may have a top edge acting either directly or indirectly to apply upward clamping force to the frame of the gun at a location about the mentioned grip mounting projection.

BRIEF DESCRIPTION OF THE DRAWINGS

The above and other features and objects of the invention will be better understood from the following detailed description of the typical embodiments illustrated in the accompanying drawings in which:

FIG. 5 is a view similar to FIG. 1, but showing a variational form of the invention;

FIG. 6 is a fragmentary transfer section taken on line 6—6 of FIG. 5;

FIG. 7 is a perspective view of the reinforcing tube of FIG. 5; and

FIG. 8 is a perspective view of another variational form of reinforcing tube; and FIG. 9 is an end view of the reinforcing tube of FIG. 8, taken on line 9—9 of FIG. 8.

DESCRIPTION OF THE PREFERRED EMBODIMENTS

Figure 1:
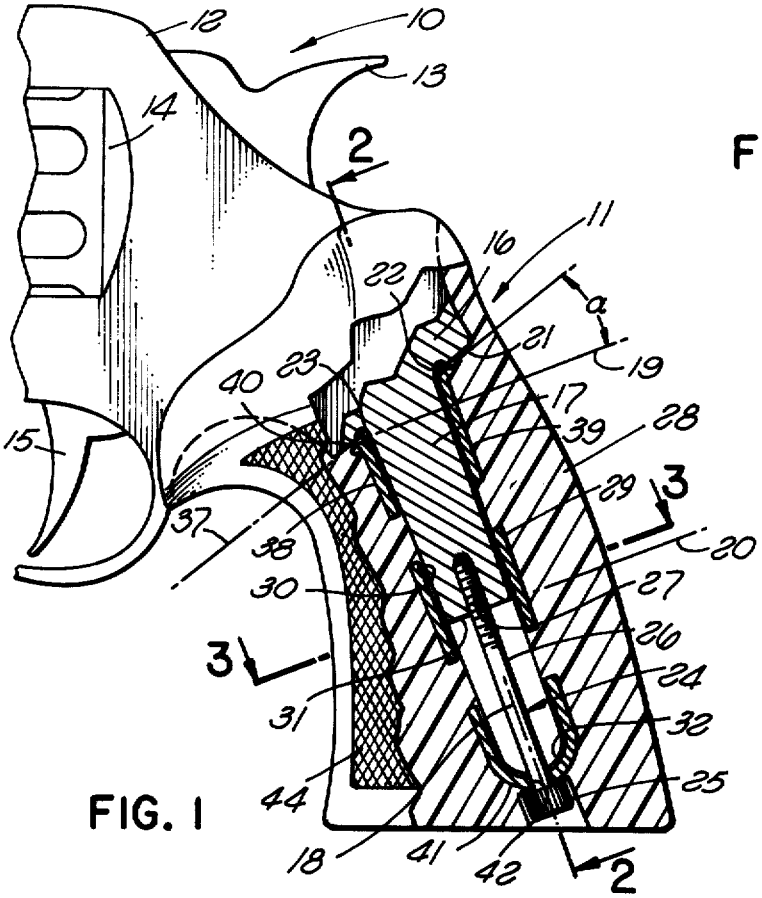
FIG. 1 is a fragmentary side elevational view, partially broken away, of a first form of pistol grip constructed in accordance with the invention, with the sectional portion of this view being taken in the vertical central front to rear plane designated by the line 1—1 of FIG. 2.
Figure 2:
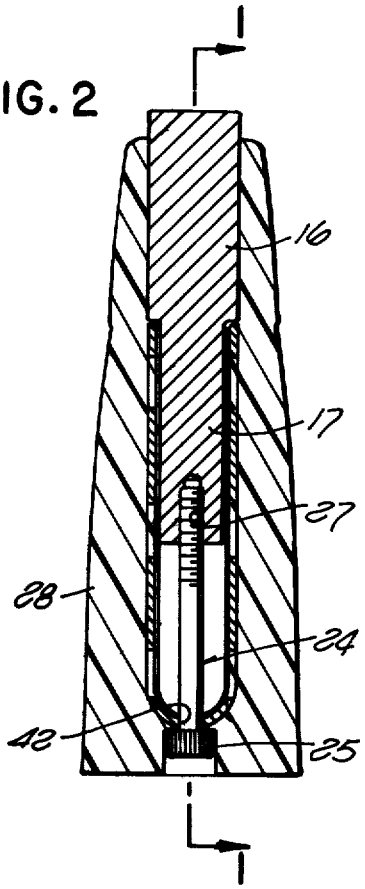
FIG. 2 is a fragmentary section taken on line 2—2 of FIG. 1.

The gun which is fragmentarily represented at 10 in FIG. 1 is a pistol of known, completely conventional construction except with regard to the structure of a cushioned grip until 11 embodying the present invention, which has been applied to the handle portion of the gun. More particularly, the conventional portion of the gun includes a main frame 12 of the pistol moveably carrying a hammer 13 for firing cartridges contained within a revolving cylinder 14 under the control of a trigger 15 and through the barrel of the gun (not shown). Frame 12 is formed of steel and has, at its near end, a portion 16 integrally carrying a rigid metal projection 17 to which the cushioned grip unit 11 is secured. Projection 17 extends along a downwardly and rearwardly inclined axis 18, and has the essentially square cross-section illustrated in FIG. 3 transversely of that axis. This cross-section is uniform along substantially the entire axial extent of projection 17, between two planes designated by the lines 19 and 20 in FIG. 1. Projection 17 terminates upwardly at an inclined shoulder 21 which does not extend directly transversely of axis 18, but rather is disposed at the acute angle A with respect to directly transverse plane 19. The square cross-sectional configuration of projection 17 continues upwardly beyond plane 19 except insofar as the front and side surfaces of the projection are terminated by the angularity of shoulder 21. Extending across the front and rear sides of the upper extremity of projection 17, the inclined downwardly and rearwardly facing shoulder 21 on portion 16 of the gun frame may contain two transverse parallel grooves 22 and 23.

As a gun of the type illustrated in FIG. 1 is conventionally sold, there is attached to projection 17 a one piece, rigid, molded handle grip element, shaped externally to a handle configuration, and containing an internal recess into which projection 17 extends to attach the handle element to the gun frame. The parts are secured together by a threaded screw such as that represented at 24 in FIG. 1, having an enlarged head 25 bearing against a shoulder formed in the rigid one piece body, and having a reduced diameter shank 26 projecting upwardly at an angle and threadedly connected into an internally threaded bore or socket 27 in the lower end of projection 17.

The grip unit 11 of the present invention includes a main body 28 of rubber or another appropriate resiliently deformable elastomeric material, and an inner reinforcing structure or part 29 embedded within and permanently bonded to the elastomeric material of body 28. These parts together form and contain an internal recess 30 extending along axis 18 and dimensioned to closely receive projection 17 in interfitting relation. The recess 30 desirably extends downwardly well beyond the lower extremity 31 of projection 17, and preferably to the location designated by the number 32 in FIG. 1.

Figure 3:
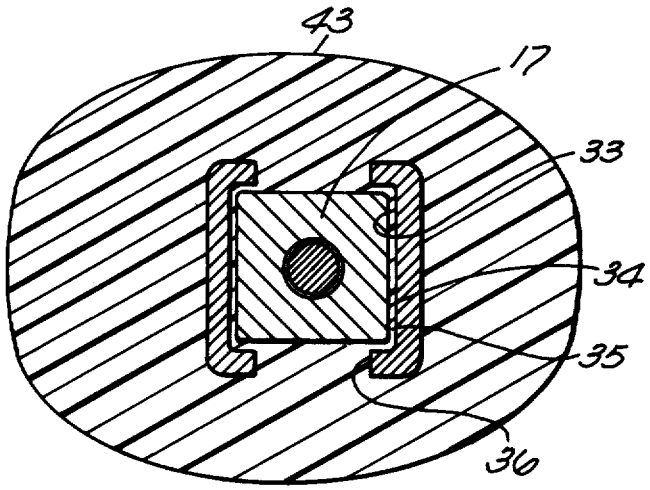
FIG. 3 is an enlarged section taken on line 3—3 of FIG. 1.
Figure 4:
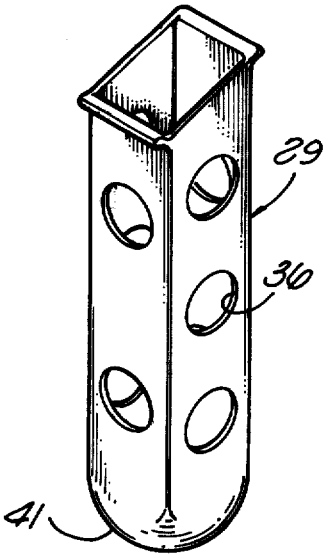
FIG. 4 is a perspective view of the reinforcing element of the FIG. 1 device.

Reinforcing part 29 is formed of a material substantially stiffer or more rigid than the elastomeric material of body 28, and in a presently preferred arrangement is formed of steel or other metal having sufficient strength and rigidity to maintain its illustrated shape without deformation under all conditions of use of the gun. The rigid part 29 is formed essentially as a tube, centered about axis 18 and having a square cross-sectional configuration approximately the same as the external sectional shape of projection 17 (FIG. 3). More particularly, the internal surface 33 of reinforcing part 29 has a cross-section just slightly greater in size than the external surface 34 of part 17, to fit fairly closely on that projection. Desirably, a thin layer 35 of the elastomeric material 28 extends along the inner surface of reinforcing tube 29, to form the wall of the previously mentioned recess 30 in the composite grip unit 11. This wall 30 is a close fit on projection 17 to hold the grip unit in fixed aligned relation with respect to projection 17 when the parts are assembled. The layer 35 of elastomeric material at the inside of part 29 is connected integrally to the main portion of the elastomeric body 28 at the outside of tube 29 by extension of some of the elastomeric material through series of vertically spaced apertures 36 formed in the different sides of tubular part 29. The elastomeric material is continuously bonded to part 29 over all of the surfaces of that part, with the bond being enhanced by reception of some of the elastomeric material within aperture 36.

The square cross-sectional configuration of reinforcing part 29 as illustrated in FIG. 3 is uniform along the entire vertical extent of that tube, except at its extreme upper and lower ends. At the upper end, the cross-section is altered slightly by truncation of the upper extremity of the tube in a non-transverse plane 37 disposed at the angularity of the previously discussed inclined shoulder 21 on the gun frame. Also, the front and rear walls 38 and 39 of tube 29 may be curved or flared slightly outwardly at their upper extremities 40 as seen in FIG. 1, in essential correspondence with the curvature of the walls of grooves 22 and 23. As in the case of the inner surfaces of reinforcing tube 29, the upper edges of that tube may be covered by a very thin layer of the elastomeric material of body 28.

At the lower end of part 29, the material of this part is deformed to provide a downwardly convexly curved or rounded, preferably hemispherically curved bottom wall 41, containing a central opening 42 through which the shank of screw 24 extends. The enlarged head 25 of the screw is engageable upwardly against the convexly curved wall 41 circularly about opening 42, to clamp the part 29 tightly between head 25 and the shoulder 21 and grooves 22 and 23 of the gun frame.

To install the grip unit 11 on the gun frame 12 after removal of the conventionally provided rigid grip element, the composite unit 11 is first moved to a position in which its internal recess 30 is aligned with projection 17, and then by moving the unit 11 upwardly and leftwardly along axis 18 relative to frame 12, the projection 17 can be slidably inserted into recess 30 to the position illustrated in FIG. 1. Screw 24 is then advanced upwardly through opening 42 in the lower rounded end of reinforcing part 29, and is tightened against the bottom wall 41 of part 29 to clamp that part between the head 25 of the screw and shoulder 21. It is of course understood that the upper edges of part 29 may not directly contact shoulder 21 or its grooves 22 and 23, because of the provision of the previously discussed thin layer of elastomeric material on the upper edges of tube 29, and similarly, there may be a thin layer of elastomeric material covering the under surface of part 29 about opening 42 and preventing direct engagement of the metal parts at that location. The part 29 is, however, effectively clamped between head 29 and shoulder 21 in a manner very positively retaining part 29 in rigidly fixed position with respect to projection 17 of the gun frame. Such rigid retention of the reinforcing part 29 effectively locates the elastomeric body 28 which is bonded thereto, preventing excessive deformation of that elastomeric body while at the same time allowing cushioning resilient deformation of the outer surfaces 43 of that elastomeric material. As will be apparent from FIGS. 1 and 3, those outer surfaces are shaped to a configuration enabling easy grasping of the grip unit by a person's hand, and the opposite side surfaces of the elastomeric material are preferably checkered or otherwise irregularized as represented at 44 in FIG. 1.

Upwardly and forwardly beyond the plane 37 of shoulder 21, the elastomeric material of body 21 is shaped internally to receive and fit closely about the previously mentioned rear portion 16 of the gun frame, and is formed externally to continue the outer handle configuration of the body.

The variational form of grip unit illustrated at 11*a* in FIGS. 5–7 is similar to the unit 11 of FIGS. 1–4 except for a change in configuration to fit a somewhat different type of conventional gun frame 12*a*. This frame 12*a* has a rear portion with a shoulder 21*a* similar to that represented at 21 in FIG. 1, and beyond which a rigid projection 17*a* extends along a rearwardly and downwardly inclined axis 18*a*. Projection 17*a* is externally cylindrical about axis 18*a*, rather than of square cross-section as illustrated in FIG. 3. Also, the projection 17*a* is shorter than the projection 17 of FIG. 1, and more specifically terminates at a lower end surface 31*a* disposed transversely of axis 18*a*. A small spring 45 is carried by frame 12*a* at the front of the projection 17*a*.

Grip unit 11*a* of the second form of the invention includes an elastomeric cushioning body 28*a* and rigid reinforcing part 29*a* embedded in body 28*a* and bonded continuously to it. The part 29*a* may be a straight cylindrical tube of circular cross section as seen in FIG. 6, containing bonding apertures 36*a*, and desirably having a thin layer of the elastomeric material coating the inner surface of part 29*a*. At its lower end, tube 29*a* is deformed to have a rounded, downwardly convex, preferably spherically curved bottom wall 41*a*, containing an aperture 42*a* through which the shank of a retaining screw 24*a* extends. As in the first form of the invention, the shank 24*a* is threadedly connected into projection 17*a* at 27*a*, and the enlarged head 25*a* exerts upward clamping force against bottom wall 41*a* of the tube, preferably through a thin layer of the elastomeric material at 46. The upper extremity of the tube is cut off in the plane 37*a* of shoulder 21*a*, to bear upwardly against that shoulder except at the location of a tab 47 formed at the front of the tube 29*a* at the location of spring 45 and its containing housing structure. This tab is formed by slitting tube 29*a* downwardly along two parallel lines from the upper edge of the tube, to enable the portion 47 to be curved forwardly and then downwardly at the underside of the spring 45 and its housing to avoid contact therewith, while at the same time enhancing the bond between the elastomeric material and the tube by virtue of extension of the tab 47 into the interior of the elastomeric material. As in the first form of the invention, the elastomeric material extends upwardly and forwardly beyond the plane of shoulder 21*a*, and typically to an edge 48 extending about the gun frame, with the interior of this upper and forward portion of the elastomeric material being shaped to exactly receive and closely fit the rear portion 16*a* of the gun frame. Externally, the elastomeric material is shaped to an appropriate curving handle configuration easily grasped by a user.

In applying the unit 11*a* to the gun frame 12*a* of FIG. 5, after first detaching the conventionally supplied rigid grip part from the frame, a user first positions unit 11*a* at a location in which the internal cylindrical recess 30*a* within tube 29*a* is aligned with projection 17*a*. Unit 11*a* is then moved along axis 18*a* relative to frame 12*a*, to slidably advance projection 17*a* into recess 30*a*, and screw 24*a* is then inserted through unit 11*a* and threadedly connected into projection 17*a* to clamp part 29*a* tightly between the head 25*a* of the screw and shoulder 21*a* of the frame. This rigidly locates the reinforcing tube 29*a* relative to the gun frame, while allowing some resilient deformability of the external surfaces of elastomeric body 28*a* to cushion the contact between the user's hand and the grip unit.

FIGS. 8 and 9 illustrate another variational type of reinforcing tube 29*b* which may be utilized in the arrangement of FIGS. 1–4, in lieu of the tube 29 of those figures. In FIGS. 8 and 9, the bottom wall 41*b* of the reinforcing element is formed as a separate part welded to the lower end of the tube 129*b* which forms the main portion of the reinforcing element. This tube 129*b* may be of the same square cross-sectional configuration as element 29 in FIGS. 1–4, but instead of being deformed at its lower end to form the hemisperically rounded bottom wall 41, the tube 129*b* of FIGS. 8 and 9 is cut off in a plane perpendicular to the axis 18*b* of the tube, and the separately formed part 41*b* is disposed across that open lower end of the tube to partially but not completely close it. Part 41*b* may be a simple metal flat washer of an appropriate diameter to bridge the end of the tube as shown. More particularly, the radially outer edge 49 of that washer may be of a diameter slightly less than the width w of each of the four sides of square tube 129*b*, and the opening 50 within the washer may be of a size corresponding to opening 42 in bottom rounded wall 41 of the reinforcing device of FIG. 1. The retaining screw 24 may then extend through opening 50, and the enlarged head 25 of the screw may exert force upwardly against washer 41*b* (preferably through a thin layer of rubber as previously discussed), to tighten the two upper edges 51 of the tube toward the shoulder 21 of the gun handle.

In order to effectively transmit axial force from washer 41*b* to the four sides of the tube 129*b*, a lower portion of each of those side walls may be deformed locally inwardly as represented at 52, so that the edge of the washer is received in axially abutting engagement with the side walls of the tube at four spaced locations. At each of these locations, a spot weld or other weld 53 may then be formed between the inwardly deformed portion of the tube sidewall and the engaged peripheral portion of washer 41*b*, to rigidly secure the washer to the tube in the relation illustrated.

At its upper end, the front wall 54 of the tube may be slit downwardly from its top edge to form a number of fingers 55 which are bent forwardly as illustrated in FIG. 8, and in a manner similar to the tab 47 of FIGS. 5–7. Similarly, the back wall of the reinforcing tube 29*b* may be deformed rearwardly as represented at 56 in FIG. 8.

The reinforcing tube of FIGS. 8 and 9 is embedded within the elastomeric material of the handle grip at the time of molding, with the forwardly and rearwardly deformed portions 55 and 56 at the top of the tube projecting into the elastomeric material in a manner enhancing the bond between the metal and rubber at those locations. At the bottom of the reinforcing part 29*b*, the elastomeric material is able to flow into the four gaps or passages 57 formed between the corners of the tube 129*b* and washer 41*b*, to further improve the connection between the rubber and metal. As in the first form of the invention, a thin layer of rubber preferably coats the entire inner surface of the metal tube. Because of the effect of deformed portions 55 and 56 at the top of the tube, and the reception of some of the elastomeric material within the gaps 57 at the bottom of the tube, it is found possible to omit the sidewall apertures 36 which are present in the first form of the invention. It is contemplated that an arrangement similar to that shown in FIGS. 8 and 9 may be employed with a circular tube of the type shown in FIGS. 5 and 6, with a separately formed washer or bottom wall being welded or otherwise secured to the lower end of the tube rather than providing the tube with an integral rounded wall 41*a*.

While certain specific embodiments of the present invention have been disclosed as typical, the invention is of course not limited to these particular forms, but rather is applicable broadly to all such variations as fall within the scope of the appended claims.

We claim:

1. For use with a gun having a frame with a grip mounting projection extending from the frame along essentially a predetermined axis:

a grip detachably connectable to said frame and containing a recess for receiving said projection in a relation enabling movement of the grip relative to the frame essentially along said axis between a mounted position in which the projection extends into the recess and a separated position in which the projection is withdrawn from the recess;

said grip including a body of elastomeric material extending about said recess and having external gripping surfaces at its opposite sides for cushioned engagement with a user's hand, and a reinforcing structure embedded in and stiffer than said elastomeric material and having portions received at opposite sides of said recess at locations to axially overlap said projection in said mounted position of the grip;

said grip being adapted to pass upwardly therethrough a fastener connectable to said projection to retain the grip in said mounted position;

said reinforcing structure having a portion positioned to be clamped upwardly by said fastener to retain the reinforcing structure between the fastener and frame and thereby secure the grip to the frame.

2. A gun grip as recited in claim 1, in which said reinforcing structure is essentially tubular about said axis and about said recess.

3. A gun grip as recited in claim 1, in which said portion of the reinforcing structure which is adapted to be clamped upwardly by the fastener contains an opening through which a shank of the fastener extends and about which an enlarged head of the fastener can apply upward force to the reinforcing structure.

4. A gun grip as recited in claim 1, in which said reinforcing structure is essentially tubular about said axis and has a cross-section corresponding approximately to but slightly larger than said projection.

5. A gun grip as recited in claim 1, in which said reinforcing structure forms essentially a tube extending about said axis and across the lower end of which there extends said portion of the reinforcing structure which is adapted to be clamped upwardly by said fastener.

6. A gun grip as recited in claim 1, in which said reinforcing structure is formed as a tube extending about said axis and having a lower, rounded, downwardly convex end wall forming said portion of the reinforcing structure which said fastener clamps upwardly, said rounded end wall containing an opening through which a reduced threaded shank of the fastener extends and having a surface about said opening against which upward clamping force of the fastener is exerted.

7. A gun grip as recited in claim 6, in which said tube has an upper end edge applying upward clamping force to the frame about said projection.

8. A gun grip as recited in claim 7, in which said tube contains apertures within which said elastomeric material is received in bonded relation.

9. A gun grip as recited in claim 1, in which said reinforcing structure has a tubular side wall to be received about said projection and which has a tab cut from a forward portion and deformed to extend forwardly farther than laterally adjacent portions of the side wall.

10. A gun grip as recited in claim 1, in which said reinforcing structure includes a tube to be received about said projection, said portion of the reinforcing structure which is positioned to be clamped upwardly by said fastener being a bottom wall formed separately from said tube and extending across the lower end thereof and through which upward clamping force is exerted from the fastener to the tube.

11. A gun grip as recited in claim 1, in which said reinforcing structure includes a tube to be received about said projection, and a separately formed bottom wall extending across the lower end of said tube and welded thereto and containing an opening through which said fastener extends to exert upward force against said wall.

12. A gun grip as recited in claim 1, in which said reinforcing structure includes a tube of square cross-section te be received about said projection, said portion of the reinforcing structure which is clamped upwardly by said fastener being a separately formed annular bottom wall disposed across the lower end of said square section tube, said tube having four sidewalls with lower portions deformed locally inwardly to positions above spaced peripheral portions of said bottom wall, and welded thereto, with openings left between the corners of said tube and a peripheral edge of said bottom wall and into which said reinforcing material extends.

13. The combination comprising:

a gun having a frame with a grip mounting projection extending from the frame along essentially a predetermined axis; and a grip detachably connectable to said frame and containing a recess for receiving said projection in a relation enabling movement of the grip relative to the frame essentially along said axis between a mounted position in which the projection extends into the recess and a separated position in which the projection is withdrawn from the recess;

said grip including a body of elastomeric material extending about said recess and having external gripping surfaces at its opposite sides for cushioned engagement with a user's hand, and a reinforcing structure embedded in and stiffer than said elastomeric material and having portions received at opposite sides of said recess at locations to axially overlap said projection in said mounted position of the grip; and a fastener extending upwardly through said grip and connecting to said projection and acting when tightened to clamp said reinforcing structure between said fastener and frame and thereby secure the grip to the frame.

14. The combination as recited in claim 13, in which said reinforcing structure has a portion to which upward force exerted by the fastener is applied and containing an opening through which the fastener extends upwardly.

15. The combination as recited in claim 13, in which said reinforcing structure forms essentially a tube disposed about said axis and about said projection.

16. The combination as recited in claim 13, in which said reinforcing structure forms essentially a tube disposed about said axis and said recess and projection and having a lower portion to which upward force exerted by the fastener is applied.

17. The combination as recited in claim 13, in which said reinforcing structure forms essentially a tube disposed about said axis and recess and having a cross-sectional configuration corresponding approximately to but slightly greater than that of said projection.

18. The combination as recited in claim 13, in which said reinforcing structure forms essentially a tube containing apertures into which said elastomeric material extends.

19. The combination as recited in claim 13, in which said reinforcing structure has a lower, downwardly convex portion to which upward clamping force exerted by said fastener is applied.

20. The combination as recited in claim 13, in which said reinforcing structure forms essentially a tube receivable about said projection and having an upper end edge to be received closely proximate and apply upward clamping force to said frame about said projection.

21. The combination as recited in claim 13, in which said reinforcing structure is essentially a tube disposed about said axis and recess and dimensioned to fit about said projection and having a portion extending across its lower end containing an aperture for passing said fastener and against which upward clamping force of the fastener is exerted.

22. The combination as recited in claim 21, in which said portion at the lower end of said tube is downwardly convexly rounded, said tube containing apertures into which said elastomeric material extends, and said tube having an upper edge received in close proximity to said frame for applying upward clamping force to the frame about said projection.

23. The combination as recited in claim 22, in which said reinforcing structure has a tubular side wall received about said projection and having a tab cut from an upper portion thereof and formed to extend forwardly beyond the portion of the side wall directly therebeneath.

24. The combination as recited in claim 13, in which said reinforcing structure includes a tube disposed about said axis and about said projection, and a separately formed element extending across a lower end of said tube and acting to transmit upward forces from said fastener through said bottom wall to the tube.

25. The combination as recited in claim 13, in which said reinforcing structure includes a tube disposed about said projection, and a separately formed bottom wall extending across and welded to a lower end of said tube and against which upward clamping force is exerted by the fastener.

26. The combination as recited in claim 13, in which said reinforcing structure includes a tube of square cross-section and an annular bottom wall extending across the lower end of said tube and welded thereto to transmit upward forces from the fastener to the tube, there being openings provided between corners of said tube and said bottom wall within which said elastomeric material extends.

27. The method of forming a reinforcing element for a gun grip comprising:

cutting off a length of non-circular tubing having a plurality of sidewalls meeting at corners;

locally deforming portions of at least some of said sidewalls inwardly at an end of said length of tubing; and positioning across said end of the length of tubing a separately formed end wall member with its periphery located to transmit forces axially from said end wall member to said deformed portions of the side walls.

28. The method as recited in claim 27, including welding said separately formed end wall to said deformed portions of said side walls of the tubing.

29. The method as recited in claim 27, including welding the periphery of said separately formed end wall to said inwardly deformed portions of said side walls of the tubing, and leaving openings between said corners of the tubing at said end thereof and the periphery of said separately formed end wall to receive elastomeric material when the reinforcing structure is embedded in and bonded to such elastomeric material.

* * * * *